US005967765A

United States Patent [19]

Henderson et al.

[11] Patent Number: 5,967,765

[45] Date of Patent: Oct. 19, 1999

[54] DEVICE FOR PREVENTING FLAREUP IN LIQUID-FUEL BURNERS BY PROVIDING CONSTANT-RATE FUEL FLOW FROM REMOVABLE FUEL TANK

[76] Inventors: Richard W. Henderson, P.O. Box 12368, Florence, S.C. 29504-2368; E. Randolph Lucas, 141 Willets Rd., Sylva, N.C. 28779

[21] Appl. No.: 08/916,764

[22] Filed: Aug. 19, 1997

[51] Int. Cl.[6] ..... F23N 1/00

[52] U.S. Cl. ..... 431/12; 431/64; 431/319; 126/96

[58] Field of Search ..... 431/12, 64, 319; 126/96, 93, 95; 137/397, 399, 302, 29; 222/457; 141/198, 364, 18

[56] References Cited

U.S. PATENT DOCUMENTS

| | | | |
|---|---|---|---|
| 1,392,187 | 9/1921 | Mahan | 137/405 |
| 1,623,161 | 4/1927 | Buerger | 137/405 |
| 1,706,704 | 3/1929 | Phillips | 137/405 |
| 1,725,538 | 8/1929 | Remnsnider | 137/405 |
| 1,905,918 | 4/1933 | Lennmor | 431/64 |
| 2,165,162 | 7/1939 | Thornton | 431/117 |
| 2,189,871 | 2/1940 | Thomas | 431/319 |
| 2,530,237 | 11/1950 | Finley | 431/64 |

(List continued on next page.)

FOREIGN PATENT DOCUMENTS

| | | | |
|---|---|---|---|
| 572552 | 11/1958 | Belgium | 126/96 |
| 1205018 | 9/1970 | United Kingdom . | |

OTHER PUBLICATIONS

Richard W. Henderson and George R. Lightsey, "Kerosene Heater Fires: Barometric Type, " *Fire Marshals Bulletin* (87–5), pp. 8–10, Nov. 1987.

Richard W. Henderson and George R. Lightsey, "Kerosene Heater Fires: Barometric Type, " *The National Fire and Arson Report*, vol. 6 (1), pp. 2–4 (1988).

Richard W. Henderson, "Barometric Kerosene Heaters," *Fire and Arson Investigator* vol. 39 (3), pp. 26–27 (1989).

John J. Lentini, "Gasoline and Kerosene Don't Mix–At Least, Not in Kerosene Heaters," *Fire Journal*, vol. 83(4), pp. 13,86 (1989) (Jul. Aug.).

Richard W. Henderson and George R. Lightsey, "An Anti–Flareup Device for Barometric Kerosene Heaters," *Fire and Arson Investigator*, vol. 45 (2), 8 (1994).

Richard W. Henderson, "Barometric Kerosene Heaters; An Overview of Failure Modes and Solutions," *Fire and Arson Investigator*, vol. 46 (4), 13 (1996).

*Primary Examiner*—Ira S. Lazarus
*Assistant Examiner*—Sara Raab
*Attorney, Agent, or Firm*—David Pressman

[57] ABSTRACT

A safety device for preventing uncontrolled burning in wick-fed liquid fuel burners of the type where a removable tank (60) feeds a fuel chamber (40), which supplies the fuel to a wick (54), via a sump opening in the upper surface of the chamber (40). A plate (32) in the removable tank (60) contains a seat (90) and a needle (76), which, in conjunction with a compartment (80), a float (88), a lever (82), and an orifice (34), restrict fuel egress from the tank. A fill tube (44) traverses the plate. An opening (104) in the plate, along with a face (102) attached to an arm (96), allows air egress from a chamber (30) in the tank during fueling of the tank, but prevents fuel egress from the chamber when the tank is inserted in the burner. Fuel flow through the plate (32) is regulated by the movement of a float (88) attached to a lever (82), which is operatively connected to a needle (76) and a seat (90). Fuel flows through a seat (90) into a compartment (80), and begins to egress through an orifice (34). Fuel accumulates in that compartment (80), urging a float (88) and a lever (82) upward causing a needle (76) to move upward, reducing the flow through a seat (90). An equilibrium is established, in which the flow rate through a seat (90) equals that through an orifice (34). This flow rate is not affected by the depth of the fuel above the plate (32), nor by the pressure in the tank (60).

23 Claims, 2 Drawing Sheets

U.S. PATENT DOCUMENTS

| | | | |
|---|---|---|---|
| 3,169,519 | 2/1965 | Aizawa . | |
| 3,501,252 | 3/1970 | Richardson . | |
| 3,856,058 | 12/1974 | Fackler | 141/18 |
| 4,363,620 | 12/1982 | Nakamura . | |
| 4,664,095 | 5/1987 | Takahashi . | |
| 4,797,088 | 1/1989 | Nakamura . | |
| 4,872,831 | 10/1989 | Fujimoto . | |
| 5,080,578 | 1/1992 | Josephs . | |
| 5,165,883 | 11/1992 | Van Bemmel . | |
| 5,338,185 | 8/1994 | Henderson et al. | 431/34 |
| 5,409,370 | 4/1995 | Henderson | 431/2 |
| 5,456,595 | 10/1995 | Henderson . | |
| 5,549,470 | 8/1996 | Henderson . | |
| 5,551,865 | 9/1996 | Henderson et al. . | |
| 5,662,468 | 9/1997 | Henderson | 126/96 |
| 5,730,115 | 3/1998 | Henderson | 126/96 |
| 5,772,425 | 6/1998 | Henderson | 431/319 |

DEVICE FOR PREVENTING FLAREUP IN LIQUID-FUEL BURNERS BY PROVIDING CONSTANT-RATE FUEL FLOW FROM REMOVABLE FUEL TANK

BACKGROUND—CROSS-REFERENCE TO RELATED APPLICATIONS

This invention is an improvement over the inventions of several earlier applications, to-wit:

Ser. No. 08/130,290, filed 1993 Oct. 4, now U.S. Pat. No. 5,338,185, granted 1994 Aug. 16 in the names of Richard W. Henderson and George R. Lightsey;

Ser. No. 08/247,925, filed 1994 May 23, now U.S. Pat. No. 5,456,595, granted 1994 Oct. 10, in the name of Richard W. Henderson;

Ser. No. 08/297,048, filed 1994 Sep. 30, now U.S. Pat. No. 5,409,370, granted 1995 Apr. 25, in the name of Richard W. Henderson;

Ser. No. 08/365,804, filed 1994 Dec. 29, now U.S. Pat. No. 5,549,470, granted 1996 Aug. 27, in the name of Richard W. Henderson;

Ser. No. 08/514,583, filed 1995 Aug. 14, now U.S. Pat. No. 5,662,468, granted 1997 Sep. 2, in the name of Richard W. Henderson.

Ser. No. 08/559,922, filed 1995 Nov. 17, now U.S. Pat. No. 5,551,865, granted 1996 Sep. 3, in the names of Richard W. Henderson and Samuel R. Henderson;

Ser. No. 08/684,131, filed 1996 Jul 19, in the name of Richard W. Henderson; and Ser. No. 08/684,132, filed 1996 Jul. 19, in the name of Richard W. Henderson; and Ser. No. 08/829,037, filed 1997 Mar. 31, in the names of Richard W. Henderson and Kerryl L. Henderson.

BACKGROUND—FIELD OF INVENTION

This invention relates to safety devices, specifically to a mechanism for prevention of flareup in barometric-type wick-fed liquid fuel burners.

BACKGROUND—DISCUSSION OF PRIOR ART

Wick-fed liquid fuel burners, such as kerosene heaters, are used for space or area heating in cabins, mobile homes, and the like. In such burners liquid fuel from a fuel chamber is supplied to a wick which is exposed to the oxygen of the atmosphere within a wick-receiving combustion chamber. Once the wick has been ignited, flame intensity and heat generation are controlled by adjusting the length of the exposed wick.

A common type of kerosene heater is the barometric style, in which gravity causes liquid fuel to be delivered to a horizontal fuel chamber from a vertically-oriented, removable tank inserted into a mating well, or sump, in a top surface of the fuel chamber. In some cases a sight gauge is mounted on the side of the removable tank to monitor the fuel level in that tank when the tank is filled, and during operation of the burner. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which then allows air to enter the removable tank. As air enters the removable tank through the barometric valve, fuel in the removable tank flows into the fuel chamber until its level in the fuel chamber rises and covers the barometric valve, causing fuel flow from the removable tank to cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. These fires are caused, because, when high-volatility fuels are present in the burner, under certain conditions, vapors from the sump area can be ignited by the wick flame, and in other cases, fuel can overflow the fuel chamber. When the overflowing fuel ignites, the result is an uncontrolled fire, or flareup.

The most common reason for fuel overflow is the inadvertent use of fuels with high vapor pressures. Examples of such fuels are gasoline, naphtha, and inferior kerosene, which has a low flash point. In a barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at a rate greater than the rate of wick-controlled burning of the fuel. Should this process continue, the fuel chamber will overflow, since the removable tank holds about two to three liters (two to three quarts) more than the capacity of the fuel chamber. When the fuel chamber overflows, the fuel spills onto the top of the fuel chamber, and can then ignite, causing an uncontrolled fire. A second way that the partial vacuum in the barometric heater's removable tank can be lost is by air entering the removable tank due to compromise of its integrity.

There are safety devices that drop the wick down, thereby extinguishing the flame, if the burner tips over or experiences excessive vibration, or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. Nos. 4,363,620, issued Dec. 14, 1982 to Nakamura; 4,872,831, issued Oct. 10, 1989 to Fujimoto; 4,797,088, issued Jan. 10, 1989 to Nakamura; and 5,165,883, issued Nov. 24, 1992 to Van Bemmel. However, not only do these devices fail to prevent flareup, they are ineffective in stopping flareup after its onset. In some cases, the safety devices require the use of electrical power and electronic circuitry for actuation: this increases the cost of the burners significantly, without rectifying the flareup problem.

It has been suggested in two publications ("Kerosene Heater Fires: Barometric Type," R. Henderson et al., *Fire*

*Marshals Bulletin* (National Fire Protection Association), Vol. 87-5, p. 8 (1987); and "Barometric Kerosene Heaters," R. Henderson, *Fire and Arson Investigator* (International Association of Arson Investigators), Vol. 39, No. 3, p. 26 (1989)) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented and could increase the size of the burner to an unacceptable level.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above. Although some burners have sight gauges in the fuel chamber, the sight gauges are used only to indicate whether or not fuel is present, not when dangerous fuel levels are present in the fuel chamber.

In addition it was proposed that a tank block-out device be installed. In this, a float in the fuel chamber pushes a pin that moves if the removable tank is withdrawn from the heater. Once again, such a device would require a redesigning of the fuel chamber and insertion of moving parts inside a somewhat restricted space.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, Josephs' device has several disadvantages:

a) Excessive heat must be generated near the sensors before the flow of fuel is interrupted, or the wick is withdrawn. Therefore, since flareup is not prevented, the device only limits the spread of excessive flames after flareup has already occurred.

b) Heat sensing devices must be near the area where uncontrolled burning is taking place due to overflow of fuel. But often the path that the overflowing fuel takes is random and flareup may not initially occur near the heat sensors.

c) The device is not applicable to barometric liquid fuel burners—one of the most common wick-fed liquid fuel burners in use—because these burners do not have fuel lines.

d) From the onset of flareup in wick-fed liquid fuel burners, fire is present outside the wick; therefore, retracting the wick does not affect the flareup process.

The device of the above U.S. Pat. No. 5,338,185 of Henderson and Lightsey consists, in part, of an excess fuel containment compartment below the level of the fuel chamber. It prevents flareup by activating a wick-extinguishing mechanism when the presence of excess fuel is detected in the fuel chamber. While this device has much merit, to be effective it requires activation of a second mechanism, that is, an automatic wick extinguisher. Should that mechanism fail to respond, due to tar buildup on the wick or a mechanical problem, flareup may still occur in some situations.

The device of the above U.S. Pat. No. 5,456,595 of Henderson prevents flareup by lifting the removable tank when excess fuel is present in the fuel chamber, thereby shutting off the barometric valve and stopping fuel flow from the removable tank. For this device to work, a spring must be provided to lift the removable tank and its contents (liquid fuel), the total weight of which can be up to some five kilograms (ten pounds). Accordingly, should the spring lose strength, or should the removable tank become hindered in its upward movement, this device may not be able to prevent flareup in some situations.

The device of the above U.S. Pat. No. 5,409,370 of Henderson prevents flareup by dropping the pin which holds open the barometric valve in the removable tank cap, thereby closing the valve and stopping fuel flow into the fuel chamber. Should the valve not close properly, this device may not prevent flareup in some situations.

The device of the above U.S. Pat. No. 5,549,470 of Henderson prevents flareup by providing a thermal barrier between the combustion cylinder and the removable tank, which helps lower the temperature of the removable tank so that fuel vapor pressures do not become excessive. In addition, it includes a warning gauge that alerts the user to the dangerous condition of the burner when excess fuel is present in the fuel chamber. It also provides an excess fuel containment system that can hold the entire contents of the removable tank should all the fuel be released rapidly.

This system consists, in part, of a fuel containment sump, which extends upward from the top of the fuel chamber, and which surrounds the removable tank, but which does not have a closure at its top. This device has much merit in that it is effective without involving any moving parts for its operation. However, the presence of the components of the device adds to the weight of the burner.

The device of the above patent application of Henderson, Ser. No. 08/514,583, prevents flareup by containing fumes in the vicinity of the removable tank and by providing (a) a closure at the top of the compartment housing the removable tank, and (b) a block-out mechanism for the removable tank should excess fuel be present in the fuel chamber. Although this device also has much merit, it requires the introduction of a tank block-out mechanism in the sump in a somewhat restricted space.

The device of the above patent application of Henderson, Ser. No. 08/684,131, acts to prevent flareup by providing a float in the fuel chamber, which float rises in response to the presence of excess fuel in the fuel chamber. As the float rises, it moves a member which obturates an opening from the sump to the chamber, causing the opening into the fuel chamber to be closed. Should the float fail to respond, or if the opening does not seal properly, excess fuel will continue to flow into the chamber, which may result in flareup.

The device of the above patent application of Henderson, Ser. No. 08/684,132, prevents flareup by containing vapors in the sump area when the removable fuel tank is inserted into the fuel chamber. A gasket contains vapors present in the sump area when the tank is seated in the sump opening. When the tank is removed from the sump opening, a plate moves upward due to the action of a spring and contains vapors in the sump area. While this device is quite effective in preventing flareup due to vapor migration from the sump area, it does not prevent flareup should excess fuel enter the fuel chamber, causing an overflow of fuel from the fuel chamber.

The device of the above patent application of Henderson and Henderson, Ser. No. 08/829/037, prevents flareup by regulating the rate at which fuel can flow out of the removable tank into the fuel chamber. It consists of a compartment inside the removable tank such that fuel is contained inside that compartment when the tank is inserted into the heater cabinet. Fuel leaving the compartment must travel through a restrictor, which regulates fuel flow out of the removable tank. While this system does control the rate at which fuel leaves the removable tank, the rate is not constant. When the fuel is at its greatest depth, the flow rate will be at its maximum. As the level drops, the flow rate decreases in a square root fashion; for example, when the depth decreases to one-fourth of what it was originally, the flow rate will decrease to one-half of its original value.

The device of the above U.S. Pat. No. 5,551,865 of Henderson and Henderson employs a thermocouple/solenoid/lever system, which lever must be engaged until the wick flame is established sufficiently such that the solenoid can maintain the position of the lever so that it does not actuate the automatic wick extinguishing mechanism. Should excess fuel enter the fuel chamber, a float causes the thermocouple/solenoid circuit to open, which releases the lever, actuating the wick extinguishing mechanism. This device has the advantage that there is a self-test of the system each time the burner is operated. On the other hand, the device requires electrical circuitry and components for its operation. Also, should the wick extinguishing mechanism fail to operate, flareup may result.

OBJECTS AND ADVANTAGES

Accordingly, several objects and advantages of the present invention are to provide an improved and safer wick-fed, barometric, liquid fuel burner, to provide such a burner with a safety device which does not require the reduction in capacity of the removable fuel tank, does not require the redesigning of the fuel chamber to increase its capacity, does not require electrical power or electronic circuitry, does not require the presence of excessive heat for its actuation, is applicable to kerosene heaters that do not have fuel lines, and provides for a constant flow rate of fuel from the removable fuel tank, without requiring any modification of the burner other than the removable fuel tank.

In addition, the present burner is quite simple in design and inexpensive to incorporate, does not have any substantially increased weight, will save lives and property, will make barometric liquid fuel burners easier to market because of added safety value, and will likely reduce the number of expensive lawsuits prompted by injury, loss of life, and property damage.

Still further objects and advantages will become apparent from a consideration of the ensuing description and drawings.

DRAWING REFERENCE NUMERALS

Figure 1:
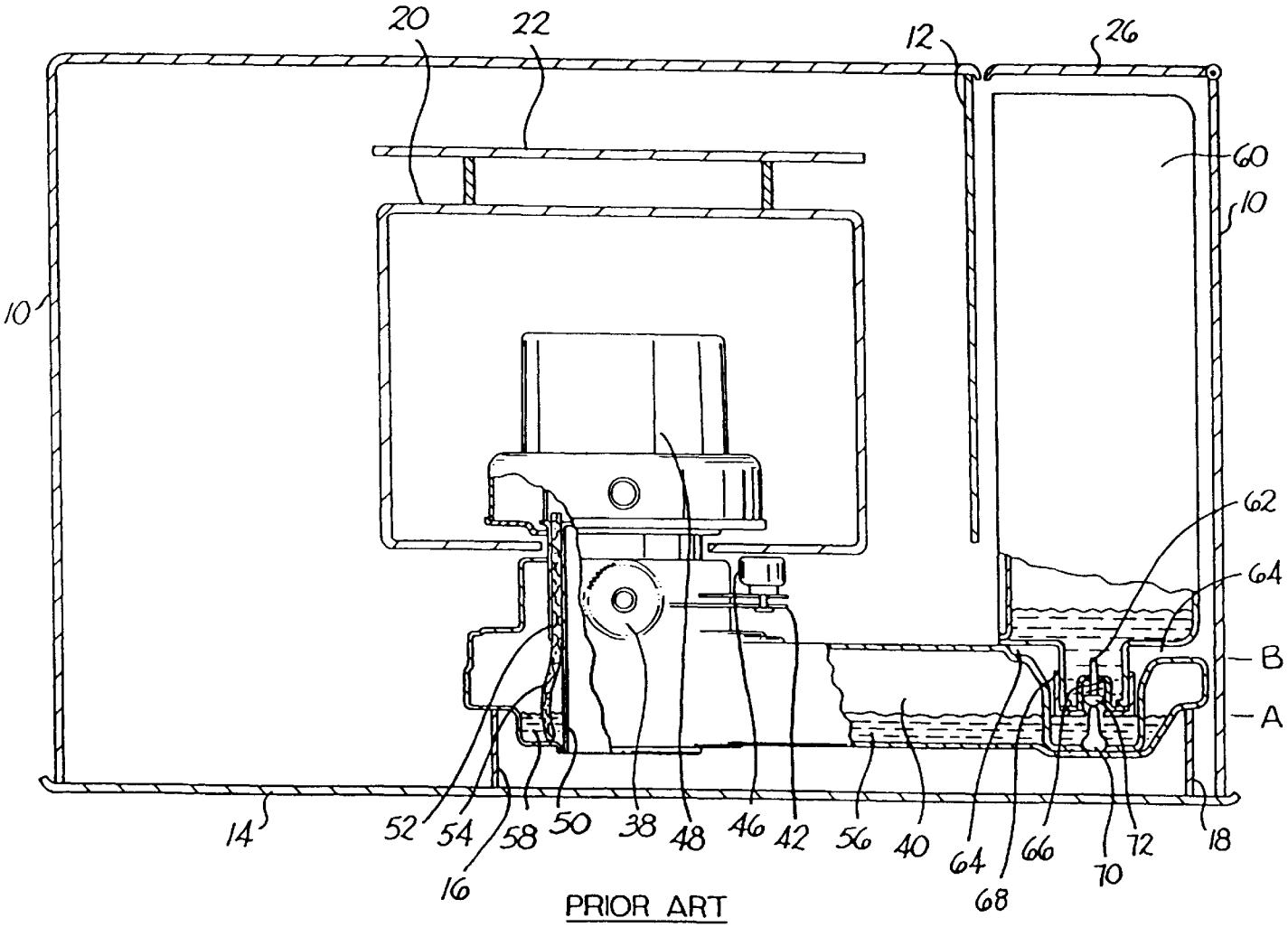
PRIOR ART FIG. 1
FIG. 1 is a side sectional view of a prior-art, wick-fed, barometric liquid fuel burner with a removable fuel tank, and an automatic wick extinguishing unit that can be activated by a vibration-sensing weight.

10 Cabinet
12 Tank guide
14 Basetray
16 Support
18 Support
20 Reflector
22 Heat shield
24 Opening
26 Lid
28 Opening
30 Upper chamber
32 Plate
34 Orifice
36 Opening
38 Wick gear
40 Fuel chamber
42 Automatic wick extinguishing unit
44 Fill tube
46 Vibration-sensing weight
48 Combustion cylinder assembly
50 Inner wick guide
52 Outer wick guide
54 Wick
56 Fuel
58 Wick fuel supply reservoir
60 Removable fuel tank
62 Plunger
64 Opening
66 Plunger spring
68 Tank cap
70 Pin
72 Plunger head
74 Guide
76 Needle
78 Support
80 Compartment
82 Lever
84 Hinge
86 Neck
88 Float
90 Seat
92 Attached at
94 Lower chamber
96 Arm
98 Hinge
100 Support
102 Face
104 Opening
106 Float
A Normal fuel level
B Flooded fuel level

SUMMARY

In accordance with the present invention, an anti-flareup safety device for wick-fed, barometric liquid fuel burners provides a constant-rate fuel flow from the removable tank into the fuel chamber, which prevents excess amounts of fuel from entering the fuel chamber, thereby preventing the flooding of the fuel chamber and flareup.

The safety device includes a fuel containment system in the removable tank to hold and restrict fuel egress from the removable tank. The system consists of a plate with a seat and an opening, a guide, a needle and a seat, a float and lever, a compartment with an opening and an orifice, a hinged arm with a face and a float, a fill tube, an upper chamber, and a chamber.

As fuel flows into the compartment through the seat, it will begin to egress through the orifice. Since the flow rate through the seat is somewhat greater than that through the orifice, fuel will begin to accumulate in the compartment. As a result, the float and lever will begin to rise, causing the needle to move upward, which reduces the flow through the seat. An equilibrium is established, in which the fuel level in the compartment will stabilize, with the rate at which fuel enters the compartment through the seat equaling that at which it exits via the orifice. The flow rate will be constant regardless of either the depth of the fuel in the tank or the pressure in the tank.

DESCRIPTION—CONVENTIONAL HEATER STRUCTURE—FIG. 1

FIG. 1 is a side sectional view of a conventional wick-fed barometric liquid-fuel burner (as described supra) that operates by burning a liquid fuel, such as kerosene. The burner is a wick-fed type with a combustion cylinder 48 and is constructed in a manner widely known in the art. One manufacturer of the burner of FIG. 1 is Toyotomi of Japan, and such manufacturer sells such burners under the trademark Kero-Sun.

In normal operation fuel is delivered from a removable fuel tank 60 to a horizontal fuel chamber 40 through an orifice in a tank cap 68 on tank 60. Tank 60 is held in a vertical position by tank guide 12 in cabinet 10 in accordance with the common practice of the industry. Cap 68, which is attached to the neck of tank 60, is inserted into a mating well, or sump, in the top surface of chamber 40, also the common practice in the industry.

When the fuel level in chamber 40 drops below level A due to fuel consumption by wick 54, air will bubble into tank 60 through an orifice in tank cap 68, and fuel (e.g., kerosene) will flow from tank 60 into chamber 40 until the level in chamber 40 reaches level A. A partial vacuum above the fuel in tank 60 maintains the fuel in tank 60 above level A until all of the fuel has been discharged from tank 60. Fuel 56, which is in fluid communication with wick 54, migrates by capillary action up wick 54 and is burned inside combustion cylinder assembly 48, which generally consists of two or three concentric inner metal cylinders and an outer glass cylinder, which is shown. The flame is not shown, but is seen as a red glow in cylinder assembly 48, above the wick.

Wick 54, cylindrical in shape and shown in a partial cross-sectional view, can be moved up or down by rotating a wick gear 38. Wick 54, wick guides 50 and 52, combustion cylinder 48, wick fuel supply reservoir 58, and vibration-sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular. Tank cap 68 is cylindrical in shape, and is threaded to allow attachment to tank 60.

The fuel burner has an automatic wick extinguishing unit 42, which includes a vibration-sensing weight 46. If the burner is vibrated excessively, unit 42 disengages wick gear 38, which lowers wick 54, extinguishing the flame, or actuates any other wick extinguishing mechanism (not shown).

OPERATION AND DANGER OF FLAREUP WITH CONVENTIONAL BURNER—FIG. 1

If the partial vacuum in tank 60 is lost, the barometric system of the burner of FIG. 1 no longer regulates fuel flow from tank 60. As stated, the partial vacuum may be lost by compromise of the integrity of tank 60, or by the presence of a high vapor pressure in tank 60, e.g., due to heating of tank 60. Most flareup incidents occur when a high-volatility fuel is inadvertently introduced into tank 60—most commonly, gasoline or gasoline-contaminated fuel. As a result, excessive fuel will flow into chamber 40. Since the capacity of tank 60 is about two liters (two quarts) greater than that of chamber 40, chamber 40 will not be able to contain all of the fuel from tank 60, if any significant amount of fuel is present in tank 60. As a result, fuel fills chamber 40 and when it reaches level B, overflows via opening 64 between tank 60 and the top of chamber 40.

The fuel spreads over the fuel chamber's surface and to other areas in the burner. The flooded fuel will ignite because the vapors from the leaked fuel are drawn by air movement toward the wick flame (not shown) in cylinder 48, which is of sufficient temperature to ignite these fumes. As a result, there will be flames in and around tank 60, causing the pressure inside tank 60 to increase dramatically, driving more fuel out of tank 60, which further increases the amount of escaped fuel, and accordingly increases the severity of the flareup. Such a flareup, if not immediately extinguished, e.g., by a human operating a $CO_2$ or other fire extinguisher designed for oil based fires, will usually cause great property damage and/or severe human injury or loss of life. In addition, the manufacturers and resellers of these devices will face expensive lawsuits due to such damage.

The flareup incidents involving high-volatility fuels do not occur immediately after the burners are lit, but usually after an induction period of one or more hours. There is a delay because these burners are utilized for heating purposes at cooler ambient temperatures. At such temperatures, even the high-volatility fuels have vapor pressures low enough that the partial vacuum above the liquid in tank 60 is adequate to maintain the column of fuel in the tank, which requires a pressure differential of only approximately 3 kPa (0.4 psi) for the 36 cm (14 in) height typical of removable tanks.

For example, at 21° C. (70° F.) the vapor pressure of the most volatile class of gasoline, Class E, is on the order of 69 kiloPascals (kPa), that is, about 10 pounds per square inch (psi). Since ambient pressure is around 101 kPa (14.7 psi), a column of gasoline nearly 5 m (15 ft) high could be maintained at such a pressure differential. However, should the temperature of the gasoline reach 38° C. (100° F.)—the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve. The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from tank 60 as fuel is consumed by the wick.

Unless the burner is in a very low temperature environment, the temperature of the removable tank will typically exceed 38° C. (100° F.) during operation of the burner. The removable tank achieves such temperatures due to its proximity, about 13 cm (5 in), to the combustion process, which reaches temperatures in excess of 850° C. (1600° F.). During operation of the burner, heat is transferred by radiation, convection, and conduction processes from the combustion cylinder to the removable tank.

The typical flareup scenario in such burners is as follows: Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, as well as the fuel inside it, increases as thermal equilibrium is established in the burner, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (1–2 liters), the fuel chamber fills and overflows. The vapors from the spilled fuel ignite and flareup ensues.

There is a second mechanism for flareup when high-volatility fuels are present. Vapors present in the sump area can be drawn to the wick flame by air currents, where they are ignited. Flames in the sump area heat the removable tank, causing it to dump its fuel in an uncontrolled manner, resulting in flareup.

With the exception of the above Henderson and Lightsey device (5,338,185), the above Henderson tank-lift, pin drop, thermal barrier/fuel containment, vapor containment/tank-block, float/fuel shutoff and sump vapor containment, and tank fuel flow regulation devices (5,456,595, 5,409,370, 5,549,470, 08/514,583, 08/684,131, 08/684,132, and 08/829,037, respectively), and the above Henderson and Henderson device (5,551,865), prior-art safety devices do not prevent flareup, but rather detect evidence that flareup has begun, and then trigger an automatic wick extinguishing unit, which acts to extinguish the flame on the wick. However, by the time flareup has begun, flames are outside the wick area, and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device (5,338,185) is designed to extinguish the flame on the wick prior to flareup. However, if the wick shutoff mechanism fails to operate when activated as a result of the wick or its mechanism becoming encrusted, this device may not be able to prevent flareup. The Henderson tank-lift and pin-drop devices (5,456,595 and 5,409,370, respectively) are designed to shut off fuel flow from the removable tank to the fuel chamber by separating the removable tank from the pin that opens the barometric device in the cap on the removable tank cap. However, these two devices have one feature in common: should they not operate properly to stop fuel flow from the removable tank, excess fuel may enter the fuel chamber.

The Henderson thermal barrier/fuel containment device (5,549,470) is a very simple and effective device; however, fuel vapors in the vicinity of the removable tank may migrate over the walls of the fuel containment sump, which surrounds the removable tank, and may be drawn to the wick flame by the air movement in the burner, where they could be ignited. Also, the added components will increase the weight of the burner. The Henderson vapor containment/tank block mechanism (08/514,583) is quite simple and effective. However, in order to contain an amount of fuel equal to the full capacity of the removable tank, this device requires either a) the incorporation of two additional compartments (beyond the fuel chamber), or b) the incorporation of one additional compartment, and an increase in the capacity of the fuel chamber. The Henderson sump vapor containment device (08/684,132) acts to contain vapors in the sump area. However, this device does not prevent excess fuel from entering the fuel chamber. The Henderson tank fuel flow regulation device (08/829,037) restricts the rate at which fuel leaves the removable tank. However, the fuel flow varies with depth of the fuel.

The Henderson and Henderson thermocouple/solenoid device (5,551,865) provides a self-test of the system each time the burner is operated. However, it requires incorporation of electrical circuits and components, and depends upon the proper functioning of the automatic wick shutoff mechanism. The Henderson float/fuel shutoff device is designed to block fuel flow into the fuel chamber when excess fuel is lost from the removable tank. Should the float not respond, or if the opening for fuel flow does not close properly, excess fuel may enter the fuel chamber.

Thus, prior-art safety devices, such as those which monitor excessive vibration of the burner, which detect high levels of $CO_2$ and low levels of $O_2$, which detect abnormal combustion, and which regulate the position of the wick to prevent excessive flaming, are ineffective in preventing flareup. The safety device described in the Josephs patent, supra, does not prevent flareup, but rather provides a wick-drop mechanism, and cuts off fuel flow through a fuel line after the onset of flareup. Since the wick-fed barometric liquid fuel burners in common use do not utilize a fuel line, Josephs' device is not applicable to them.

The Henderson and Lightsey, and the Henderson tank-lift, pin-drop, and float/fuel shutoff devices (5,338,185, 5,456,595, 5,409,370, and 08/684,131, respectively) are designed to prevent flareup, but should they not operate properly, flooding of the fuel chamber may occur, and flareup may result. In the case of the Henderson thermal barrier/fuel containment device (5,549,470), the additional components will increase the weight of the burner. To be most effective, the Henderson vapor containment/tank block device (08/514,583) requires either the incorporation of two separate compartments as an adjunct to the fuel chamber, or an increase in the capacity of the fuel chamber and incorporation of one additional compartment. The Henderson vapor containment device (08/514,583) may not prevent flareup should excess fuel enter the fuel chamber. The Henderson and Henderson removable tank fuel flow regulation device (08/829,037) does not maintain a constant flow of fuel from the removable tank. The Henderson and Henderson thermocouple/solenoid device (5,551,865) is designed to actuate the wick shutoff mechanism. However, should that mechanism fail to respond, flareup may result.

Thus while many types of safety devices are known, these devices have not yet been incorporated in liquid fuel burners; accordingly, flareups and fires continue to occur, causing loss of life, injury, and property damage.

DESCRIPTION OF INVENTIVE ANTI-FLAREUP DEVICE—FIG. 2

Figure 2:
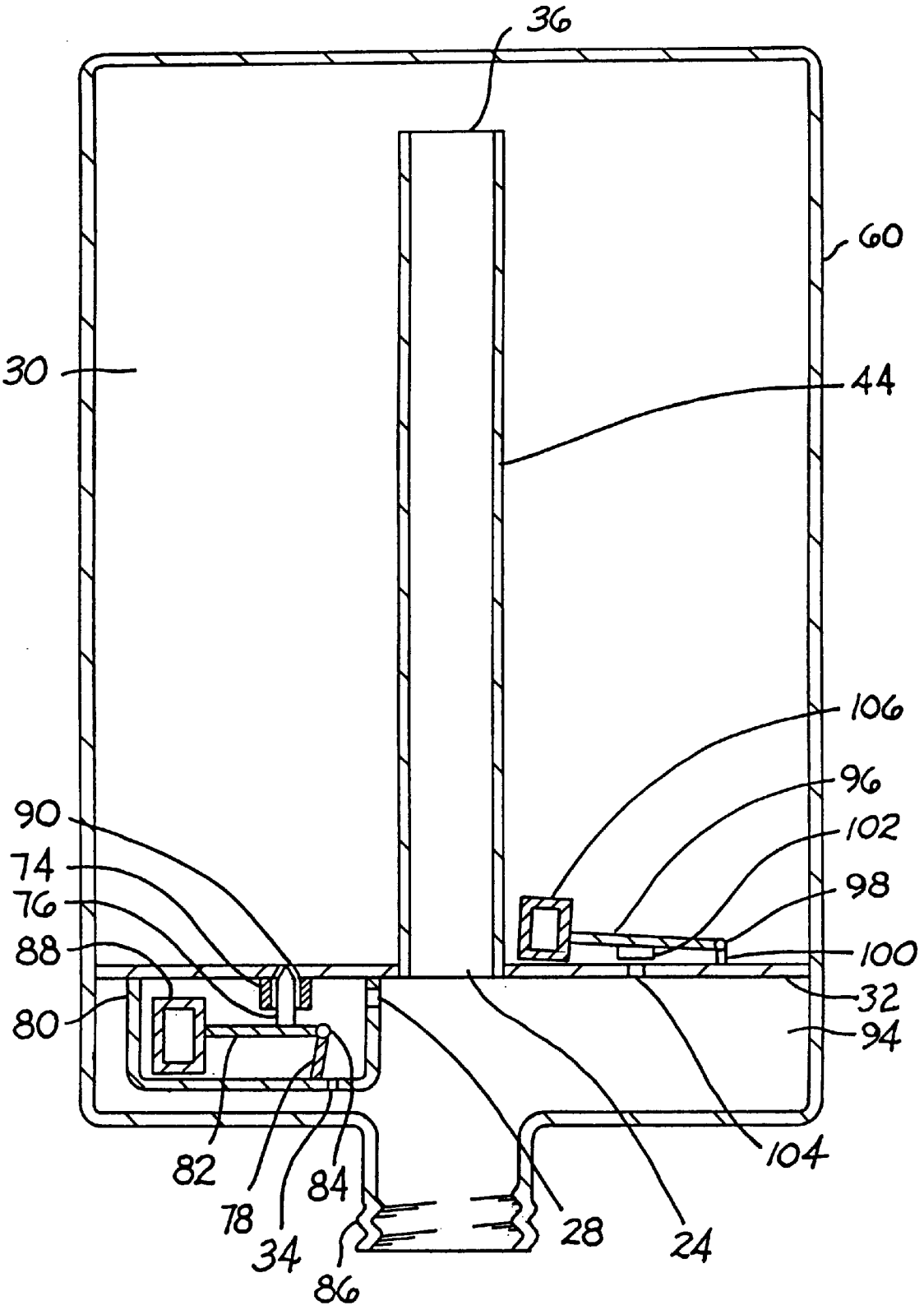
FIG. 2 is a side sectional view of a removable fuel tank with an anti-flareup safety device in accordance with the preferred embodiment of the present invention.

An improvement over the earlier anti-flareup devices which overcomes the problem of loss of excess fuel from the removable tank due to high-volatility fuels, and thereby reduces the likelihood of flareups and fires, is illustrated in FIG. 2, which shows a removable and refillable tank with my inventive addition. It operates by providing a system that regulates fuel flow from removable fuel tank 60 into the fuel chamber (not shown but similar to that of FIG. 1). It includes the following conventional elements: a tank cap 68, a plunger 62, a plunger spring 66, and a plunger head 72. In the typical fashion, as tank 60 is lowered into cabinet 10, pin 70 contacts plunger head 72, forcing it backward into cap 68, thereby allowing fuel in tank 60 to flow into fuel chamber 40.

In addition, tank 60 includes additional elements which constitute a preferred embodiment of the present inventive anti-flareup safety device. A plate 32 is located inside tank 60 near neck 86. Plate 32, which extends completely across tank 60 and is liquid tight in its attachment to tank 60, separates an upper chamber 30 and a lower chamber 94. Plate 32 is generally rectangular in shape. Its dimensions are about 15 cm by 10 cm, and its thickness is about 0.25 cm. A seat 90 is present in plate 32. Seat 90, which is circular in shape and tapered, extends through plate 32, and is approximately 0.5 cm in diameter at its widest and 0.25 cm at its narrowest. A guide 74 is affixed to plate 32 on the side closest to neck 86 and surrounds seat 90. Guide 74 is cylindrical, with an inside diameter of 1 cm and a length of 2.5 cm. A needle 76 is present inside guide 74. Needle 76 has a length of 3 cm and a diameter of slightly less than 1 cm, such that it can slide back and forth inside guide 74 without binding. The end of needle 76 proximate to seat 90 is tapered such that flow through seat 90 will be blocked when needle 76 is fully engaged in seat 90.

A fill tube 44 penetrates plate 32 and extends upward from plate 32, terminating near the top of tank 60. Tube 44, which is cylindrical, is about 2.5 cm in diameter and some 20 cm long, with a wall thickness of around 0.1 cm.

A compartment 80 is attached to plate 32 on the side closest to neck 86. Compartment 80, which is approximately 5 cm wide, 7.5 cm long, and 5 cm high, with a wall thickness of around 0.25 cm, encloses needle 76, guide 74, and seat 90. Compartment 80 has an opening 28 near plate 32, and an orifice 34 near neck 86. Opening 28 and orifice 34 have diameters of about 1.25 cm and 0.025 cm, respectively. Inside compartment 80 is a lever 82 with a float 88 at one end. Lever 82 is about 5 cm long, 1 cm wide, and 0.25 cm thick. Float 88, which is spherical is on the order of 2 cm in diameter. At its end distal to float 88, lever 82 is attached to support 78 in a hinged fashion. The untapered end of needle 76 is in contact with lever 82, preferably at a point closer to support 78 than to float 88. The float 88/lever 82 combination is configured such that its overall density is approximately 0.6 gram/milliliter, which Is less than that (0.8 gm/ml) of kerosene.

There is an opening 104 in plate 32, which opening has a diameter of around 0.5 cm. An arm 96 is attached to plate 32 in a hinged manner via a support 100. Arm 96 is approximately 5 cm long, 2 cm wide, and 0.25 cm thick. There is a face 102 on the side of arm 96 proximal to opening 104; arm 96 is positioned such that face 102 covers opening 104 when face 102 is deflected to its closest position to plate 32. The float 106/arm 96/face 102 combination is configured such that its overall density is on the order of 0.75 gram/milliliter.

Supports 78 and 100 have dimensions of about 0.5 cm by 0.5 cm, and a thickness of 0.25 cm. Plate 32, tube 44, compartment 80, lever 82, guide 74, needle 76, arm 96, and supports 78 and 100 are preferably metal, e.g., brass or aluminum. Face 102 is preferably a fuel-resistant polymeric material. Floats 88 and 106 are composed of a low-density polymeric material of the type typically used in the industry.

OPERATION OF INVENTIVE ANTI-FLAREUP DEVICE—FIG. 2

After operation of the burner for a period of time, tank 60 will become depleted of fuel, and the wick flame not shown will extinguish. Should further operation of the burner be desired, it is necessary that tank 60 be refueled. The refueling procedure consists of removing tank 60 from the burner, inverting the tank, removing cap 68, and introducing fuel into tank 60. When the tank is inverted, face 102 moves away from opening 104, allowing air movement through opening 104. As fuel enters tank 60, it will flow through openings 24 and 36 in fill tube 44, and begin to fill upper chamber 30 in tank 60. The air in chamber 30 that is being displaced by the fuel will exit the tank through opening 104 and tube 44, until the fuel level reaches opening 36, at which point air flow through opening 36 will cease. As fuel continues to enter chamber 30, air will continue to egress through opening 104.

After the fueling process is completed, cap 68 is replaced on tank 60, which is inverted and inserted into the burner in the usual fashion. Fuel inside tube 44 will flow into lower chamber 94 through opening 24. If the fuel is gasoline, float 106/arm 96, which has a density of 0.75 gram/milliliter, will remain in the downmost position, with face 102 sealing opening 104. This is because gasoline has a density of about 0.7 gram/milliliter. As a result, the only path for gasoline to flow from chamber 30 into chamber 94 is through seat 90.

As fuel flows into compartment 80 through seat 90, it will begin to egress through orifice 34. Since the flow rate through seat 90 is somewhat greater than that through orifice 34, fuel will begin to accumulate in compartment 80. As a result, float 88 and lever 82 will begin to rise, causing needle 76 to move upward, which reduces the flow through seat 90.

An equilibrium is established, in which the fuel level in compartment 80 will stabilize, with the rate at which fuel enters compartment 80 through seat 90 equaling that at which it exits via orifice 34. If no fuel is being consumed by the burner, the fuel level in chamber 94 will rise, as will that in compartment 80, which will cause float 88 to rise, and concomitantly needle 76, thereby closing seat 90.

As fuel is consumed by the burner, the fuel level in chamber 90 will drop, at which point fuel will begin to flow through orifice 34. As a result, float 88 will move downward, as will needle 76, and fuel will flow through seat 90 into compartment 80, and then out through orifice 34, which is configured to restrict the flow of gasoline to the consumption rate of the burner. The rate of fuel flow through orifice 34 is independent of the depth of fuel in chamber 30. Also, since tube 44 provides pressure equilibration to both sides of plate 34, fuel flow through the seat 90/orifice 34 system will not be affected by pressure variations in tank 60, even if a high-volatility fuel is present.

If the fuel is kerosene, its flow through orifice 34 will be somewhat less than that of gasoline, and an inadequate amount of fuel will reach the wick, if this is its only source of fuel. Accordingly, a second source of fuel flow through plate 34 is provided, namely, through opening 104.

Since the density of kerosene, which is about 0.8 gram/milliliter is greater than that of float 106/arm 96/face 102, which density is 0.75 gram/milliliter, float 106/arm 96/face 102 will be urged upward. As a result, face 102 will move away from opening 104, and this will allow sufficient flow of kerosene for the proper operation of the burner. Since the vapor pressure of kerosene is very low at the operating temperatures of liquid fuel burners, this fuel does not pose a problem with respect to compromising the partial vacuum in the removable tank.

ADVANTAGES

It is clear from the discussion above that the anti-flareup safety device is quite simple in construction, and can be readily incorporated in the removable fuel tanks of wick-fed barometric liquid fuel burners without affecting the remainder of the burner. Yet it will prevent flareup by providing a system that regulates the flow of fuel from the removable fuel tank.

The present device prevents the burning of fuel outside its intended site, that being at the wick, thereby saving fuel and reducing odor. Also, the device does not require any electrical power or electronic circuitry for the prevention of flareup. The device is quite simple, and it can readily be incorporated in the removable tanks in contemporary burners.

Clearly, the device will make wick-fed, barometric liquid fuel burners safer to operate, and accordingly, will at the same time reduce the incidence of injury, loss of life, and property damage, and will also reduce the expensive lawsuits resulting from flareup incidents. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shape and composition of the safety device can be varied, so long as its function is preserved. Fill tube 44, compartment 80, plate 32, arm 96, face 102, opening 104, float 88, lever 82, needle 76, seat 90, guide 74, orifice 34 and chamber 30 may have various cross-sectional shapes, such as square, rectangular, oval or other convenient shapes, and their locations may be changed, so long as their functions are preserved. Also, the diameter of tube 44 may be changed, so long as the opening is sufficient to allow fuel to be readily introduced into tank 60.

Opening 104 and seat 90 may be located in other locations in the plate than that shown, and they may be one opening, or may consist of multiple openings, or they may be replaced with a tube or multiple tubes. Compartment 80 need not be secured to plate 32, but may be attached to tank 60, so long as such attachment does not compromise the functioning of the float/lever/needle/seat/orifice system. Also, compartment 80 may be hinged such that its movement, rather than that of a float/lever combination, causes the deflection of the needle.

Additionally, the device may be connected to or used in combination with other safety devices, such as warning gauges, tank block features, or shutoff mechanisms.

Thus the scope of the invention should be determined, not by the examples given, but by the appended claims and their legal equivalents.

What is claimed is:

1. An apparatus for preventing flareup in a liquid fuel burner of the type comprising (a) a removable tank for holding liquid fuel, (b) a fuel chamber for receiving said fuel from said tank, (c) a sump opening in said fuel chamber where said fuel in said tank is transferred to said chamber, and (d) a combustion chamber having a wick, where said fuel chamber supplies said liquid fuel from said tank to said wick of said combustion chamber, the improvement comprising a fuel regulating system in said tank that provides a constant rate of fuel egress from said tank when said tank is seated in said sump opening.

2. The apparatus in claim 1 wherein said fuel regulating system comprises a compartment, said compartment containing an orifice, and a needle and seat assembly operatively connected to a float and a lever.

3. An apparatus according to claim 1 wherein said fuel regulating system is affixed to a plate in said tank.

4. An apparatus according to claim 1 wherein said tank contains a plate and wherein said fuel regulating system is affixed to said plate in said tank, and further including a fill tube, said fill tube traversing said plate.

5. An apparatus according to claim 1, wherein said fuel regulating system is affixed to said plate in said tank, further including a fill tube, said fill tube traversing said plate, and further including an air equalization system for allowing air egress from said tank during re-fueling of said tank.

6. An apparatus according to claim 5 wherein said air equalization system comprises an opening in said plate, a face covering said opening, and an arm attached to said plate in a hinged manner, said face being attached to said arm.

7. An apparatus according to claim 1 wherein said fuel regulating system is affixed to said plate, and further including a fill tube in said plate, said fuel regulating system comprising a needle and seat assembly and a compartment with an orifice, and further including an opening in said compartment.

8. An apparatus according to claim 7 wherein said fuel regulating system is affixed to said plate, further including a fill tube in said plate, and further including an air equalization system for allowing air egress from said tank during the re-fueling of said tank.

9. An apparatus according to claim 8 wherein said air equalization system comprises an opening in said plate, a face covering said opening, and an arm attached to said plate in a hinged manner, said face being attached to said arm.

10. A method of preventing flare-up in a liquid fuel burner of the type comprising a removable tank for holding liquid fuel, a fuel chamber, a sump in said fuel chamber where said liquid fuel in said tank is transferred to said chamber, and a combustion chamber having a wick, where said fuel chamber carries said liquid fuel from said removable tank to said wick of said combustion chamber, comprising providing a constant rate of fuel egress from said tank when said tank is seated in said sump opening.

11. The method of claim 10 wherein said providing a constant rate of fuel egress from said tank comprises providing a compartment, said compartment containing an orifice, and a needle and seat assembly operatively connected to a float and a lever.

12. The method of claim 11, further including providing a plate in said tank.

13. The method of claim 12, further including providing a fill tube, said fill tube traversing said plate.

14. The method of claim 13, further including providing an opening in said compartment.

15. The method of claim 14, further including providing an air equalization system, said air equalization system comprising an opening in said plate, a face for covering said opening, and an arm attached to said plate in a hinged manner, said face being attached to said arm.

16. The method of claim 10 wherein said providing a constant rate of fuel egress from said tank comprises providing a plate in said tank, said plate containing a seat, and further providing an air equalization system for allowing air egress from said tank during the re-fueling of said tank.

17. The method of claim 16 wherein said air equalization system comprises an opening in said plate, a face covering said opening, and an arm attached to said plate in a hinged manner, said face being attached to said arm.

18. An apparatus for preventing flareup in a liquid fuel burner comprising (a) a removable tank for holding liquid fuel, (b) a fuel chamber for receiving said fuel from said tank, (c) a sump opening in said fuel chamber where said fuel in said tank is transferred to said chamber, (d) a combustion chamber having a wick, where said fuel chamber supplies said liquid fuel from said tank to said wick of said combustion chamber, and (e) regulating means for providing a constant rate of fuel egress from said tank when said tank is seated in said sump opening.

19. An apparatus according to claim 18, further including a plate in said tank.

20. The apparatus of claim 19 wherein said regulating means comprises a compartment, said compartment containing an orifice, and a needle and seat assembly operatively connected to a float and a lever.

21. An apparatus according to claim 19, further including an opening in said compartment.

22. An apparatus according to claim 21, further including a fill tube, said fill tube traversing said plate.

23. An apparatus according to claim 22, further including an air equalization system for allowing air egress from said tank during the re-fueling of said tank, said air equalization system comprising an opening in said plate, a face covering said opening, and an arm attached to said plate in a hinged manner, said face being attached to said arm.

* * * * *